United States Patent [19]

Farrar

[11] Patent Number: 4,699,282

[45] Date of Patent: Oct. 13, 1987

[54] BEER DISPLAY, KEG COOLER

[76] Inventor: Kenneth D. Farrar, 118 Blanco, San Marcos, Tex. 78666

[21] Appl. No.: 833,249

[22] Filed: Feb. 27, 1986

[51] Int. Cl.[4] ..... B65D 90/04; A47J 41/00

[52] U.S. Cl. ..... 215/12 A; 215/13 R; 206/523; 220/412; 220/467; 220/83; 220/DIG. 6

[58] Field of Search ..... 215/12 A, 13 R, 12 R; 206/523; 220/411, 412, 413, 408, 461, 465, 467, 83, DIG. 6

[56] References Cited

U.S. PATENT DOCUMENTS

| | | | |
|---|---|---|---|
| 3,779,298 | 12/1973 | Piccirilli et al. | 215/13 R |
| 4,228,908 | 10/1980 | Tweeton | 215/12 A |
| 4,240,272 | 12/1980 | Tiede et al. | 215/13 R |
| 4,273,245 | 6/1981 | Machalek | 215/13 R |
| 4,339,062 | 7/1982 | Witt, Jr. | 215/13 R |
| 4,549,410 | 10/1985 | Russell | 215/13 R |

FOREIGN PATENT DOCUMENTS

| | | | |
|---|---|---|---|
| 841123 | 6/1952 | Fed. Rep. of Germany | 215/13.1 |
| 155313 | 6/1982 | German Democratic Rep. | 215/13 R |

*Primary Examiner*—Joseph Man-Fu Moy
*Attorney, Agent, or Firm*—Bradford E. Kile

[57] ABSTRACT

A beer display, key cooler is provided for facilitating access of beer keg to and from said cooler, of beer from said keg in said cooler, for increasing structural integrity of the cooler, for effecting easy transportation of said cooler, and for manifesting indicias of beer in display. The cooler includes an elevated internal bottom, and recessed handles integral with the cooler exterior shell. In addition, the beer keg sits in said cooler approximately flush with the upper rim of the cooler. Externally, the combined beer display and keg cooler resembles the appearance of a proportionally enlarged beer can.

12 Claims, 6 Drawing Figures

FIG. 1
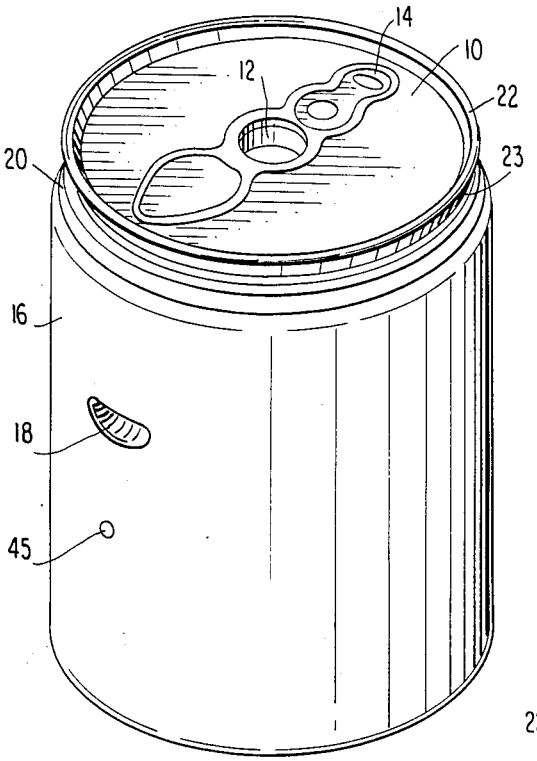
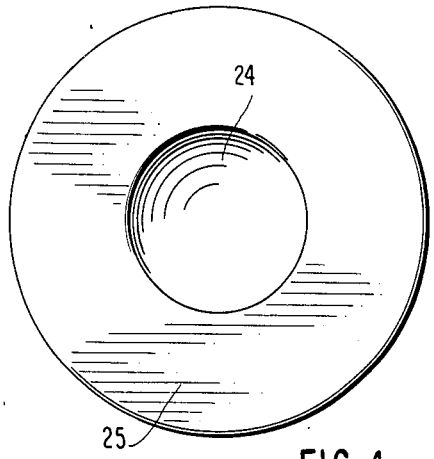
FIG. 4
FIG. 2
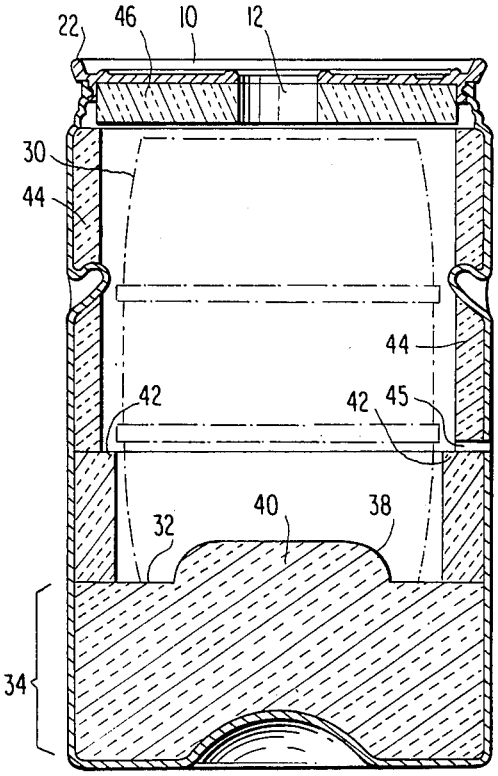
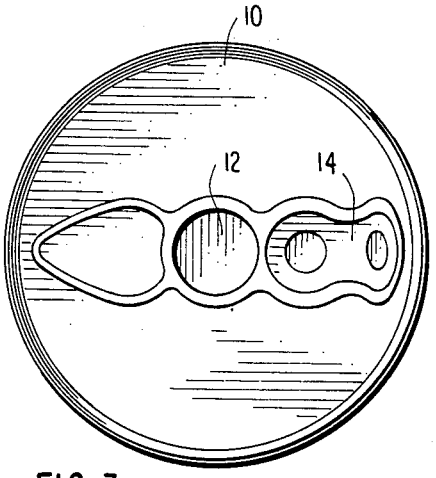
FIG. 3

BEER DISPLAY, KEG COOLER

RELATED APPLICATION

This application relates to an application for U.S. design patent filed by the undersigned on an even date herewith and also entitled BEER DISPLAY, KEG COOLER.

BACKGROUND OF THE INVENTION

This invention relates to a beer display, keg cooler. More particularly, this invention relates to a structure for effectively providing an indicia of beer, for securely holding a beer keg, for facilitating convenient access, for providing easy storage and transportation, and for maintaining a self-enclosed, environmentally isolated cooler.

The basic concept of a beer keg cooler is to maintain a uniformly cool temperature of beer within the keg. This has been traditionally accomplished in the past through a cooler structure approximately the size and configuration of the beer keg and made of various insulating material. The structure thus adds an additional layer of insulation for keeping the beer keg separate from the elements of open atmosphere. In some instances, a compartment partially or entirely surrounding the beer keg but still within the cooler structure, is provided for holding a coolant such as ice to act as a cooling agent on the keg contents.

At least some problems associated with beer keg cooler structures of the prior art have been that in almost all instances, they are oblique and angular in corresponding to the configuration of a beer keg contained therein, approximately the relative size of a standard beer keg, and have protruding handle bars. These features tend to create a number of undesirable effects when making use of the cooler.

An oblique or angular cooler construction is more likely to receive the full force of external impact through which the cooler structure may be dented or otherwise extensively damaged. The oblique structure is less able to deflect the impact generated through external forces. Dents or other damage to the shell of a cooler structure may in turn diminish the cooler's effectiveness in holding the beer keg inside and in maintaining the temperature of the keg contents.

Furthermore, a cooler structure approximately the size of a beer keg does not reach sufficient height to enable convenient access to the keg contents, especially through a tab and pump at the top of the cooler. A cooler structure having the height of a standard keg requires a stronger pump mechanism for piping the beer through a longer vertical distance to a dispenser. Furthermore, the keg is poorly situated in the cooler such that maneuvering of the same in and out of the cooler is made difficult. The keg is deeply set at a base level, and many times not flush with a top edge of the cooler in which case access thereto is made more difficult.

A cooler structure with protruding handles separate from the main body of the cooler is more susceptive to breakage of the handles near or on the point of linkage between each handle and the cooler main body. An assembly made of a plurality of parts coupled together is more fragile than an assembly having an integral structure. Furthermore, protruding parts from a body are likely to constitute a potential hazard during transportation of the cooler holding a beer keg.

The cooler structures in the past often do not provide a sufficiently self-enclosed environment in containing a beer keg. When toppled or tipped, either beer or other coolants may be easily spilled to cause a mess. Even when a lid is provided, the lid is oftentimes not securely attached via reliable means, or it may not itself be insulated.

In addition to structural deficiencies in previously known beer keg coolers little, if any, attention has been devoted to the concept of a cooler and beer displayer unit so as to generate an indicia of beer effectively. A carton box may be used to hold a beer keg and to support the beer keg; however, it does not effectively provide an indicia of the contents. An ordinary glass may be used to hold beer, but it is not closely associated with any indicia of beer. An effective beer display structure not only has to securely support beer contents, but also through its structure maximize and enhance the impression of certain indicias of beer.

The problems and limitations suggested in the preceding are not intended to be exhaustive, but rather are among many which may tend to reduce the effectiveness of beer keg coolers of the prior art. Other noteworth problems may also exist; however, those presented above should be sufficient to demonstrate that beer display structures and beer keg coolers of the prior art have not been altogether satisfactory.

OBJECTS OF THE INVENTION

It is, therefore, a general object of the invention to provide a beer display, keg cooler which will obviate or minimize problems and disadvantages of the type previously described.

It is a specific object of the invention to provide a novel beer display, keg cooler for suitably deflecting force of external impact.

It is another specific object of the invention to provide a beer display, keg cooler especially operative to receive and/or to inherently manifest indicia of beer.

It is a further object of the invention to provide an improved beer display, keg cooler for a conventional beer keg operative to facilitate access of beer therefrom.

It is still another object of the invention to provide an improved beer display, keg cooler for facilitating access of beer keg in and out of the cooler.

It is yet another object of the invention to provide a beer display, keg cooler with enhanced stability of a beer keg located within the cooler.

It is a further object of the invention to provide a beer display, keg cooler with enhanced visual effects manifesting an indicia of beer for use as an identification and marketing device.

It is still a further object of the invention to provide a beer display, keg cooler of enhanced structural integrity, and isolation of an ambient environment and which may be faciely handled.

It is a further object of the instant invention to effect any two or more of the foregoing objectives.

BRIEF SUMMARY OF A PREFERRED EMBODIMENT

One preferred embodiment of the invention which is intended to accomplish at least some of the foregoing objects comprises a beer display, keg cooler having a smooth cylindrical external configuration having an exterior configuration proportional to be approximately that of a beer can. The cooler structure has an elevated false bottom section for providing enhanced elevation within the cooler such that the top of a beer keg may be positioned flush with a top rim of the cooler. A curved bulging base is extended on top of said false bottom to centrally fit an indented base of a standard beer keg. In addition, the cooler structure includes integral inwardly extending handle recesses from the main body for allowing firm grasp by a user during transportation of the cooler. The recesses are integral in structure with the main body of the cooler for minimizing potential failure. These recesses synergistically provide stability, as they terminate in close proximity to the perimeter of an inserted beer keg.

In describing the invention, reference has been made to a preferred embodiment. Those skilled in the art, however, and familiar with the disclosure of the subject invention, may recognize additions, deletions, substitutions, modifications and/or other changes which will fall within the purview of the invention as defined in the following claims.

BRIEF DESCRIPTION OF DRAWINGS

FIG. 1 illustrates an external perspective view of one side of the beer keg cooler in accordance with a preferred embodiment of the subject invention.

FIG. 2 illustrates the bottom of the beer keg cooler of FIG. 1.

FIG. 3 illustrates the top of the beer keg cooler of FIG. 1.

FIG. 4 illustrates a vertically divided cross sectional view of the beer keg cooler with a beer keg contained therein.

DETAILED DESCRIPTION

Figure 5A:
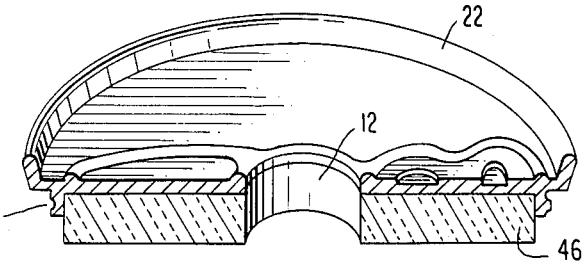
FIG. 5A illustrates a lid of the beer cooler structure removed from the main body portion and in a vertically divided cross sectional view.

Referring now to the drawings wherein like numerals indicate like parts, FIG. 1 shows a perspective external view of the novel beer display and keg cooler structure. A lid 10 having a tap hole 12 and figurative design 14 thereon is situated on top of main body portion 16. The main body portion 16 is generally cylindrical in configuration, resembles a conventional beer can in enlarged proportions. Main body portion 16 has integral recesses 18 one on each opposing side in a diametrically corresponding relationship at an approximate equal elevation (only one shown in FIG. 1). The top of main body portion, as referenced by numeral 20, is taperedly indented and includes a raised wall area 23 for receiving the lid 10. Furthermore, lid 10 has a circumferential flange area 22 for facilitating ease of manipulation. This flange partially rests on raised wall area 23. FIG. 2 illustrates the bottom of a beer keg cooler according to the instant invention. A recessed dome 24 is shown. Edge area 25 may either be tapered or sharply angled. Whether the recess dome 24 is present, and if so, of what size, does not meaningful affect the function and utility of the cooler. The bottom surface may be of other ordinarily selected construction. FIG. 3 illustrates the lid 10 from above. Design area 14 does not meaningfully alter the function and utility of the cooler, as does the tap whole 12 through which fluid contents of a keg located in the cooler may be pumped. Nevertheless, the configuration of the combined beer display and keg cooler enhances the capacity to manifest certain indicias of beer, such as identification and/or marketing labels and figurative designs such as that indicated at 14.

FIG. 4 illustrates a transparent lateral view of the generally cylindrical beer keg cooler according to the instant invention, with a beer keg 30 located therein. Numeral 32 designates an elevated false bottom section for raising the level of the keg; it is greater in height than half the radius of the cooler's cylindrical shell from its inner surface in this embodiment. However, this fraction may be as low as one quarter while still manifesting an enhanced accessibility and manipulatability condition derived from enhanced elevation. Numeral 34 identifies the height of the elevated bottom section. Since a standard keg has a recessed bottom portion 38, the elevated cooler bottom 32 also includes a bulging dome 40 for fitting into said recess, not necessarily in a perfect fit since variations in the degree of recess may vary from among different kegs. In its elevated position, the keg sits with its top surface being generally flush with respect to the top of the main body portion of the cooler, and in close juxtaposition with lid 10.

Keg collar 42 provides a guiding relationship with the keg 30. The collar extends circumferentially about the inside surface of the cooler. Numeral 44 designates compartments provided for in the cylindrical main body portion for holding insulation material. Recessed grasping areas 18 integral with the cooler main body portion are shown in a position above the keg collar 42. Dashed contour lines illustrate a beer keg located within the cooler. Lid 10 as shown has a flange area 22 and a tap hole 12. In addition, insulation material may be inserted in area 46 of the lid.

A drain hole 45 is located essentially immediately above the annular collar at a defined position. It functions to drain off any fluid accummulation within the cooler structure resulting from spillage or condensation.

Figure 5B:
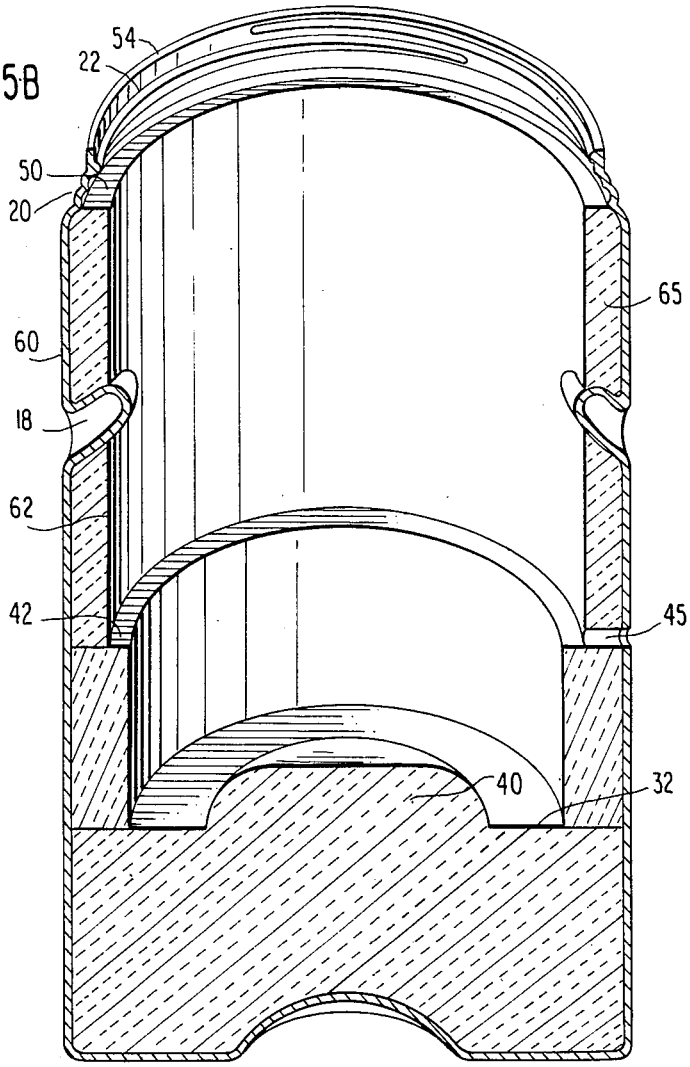
FIG. 5B illustrates a main body portion of the beer keg cooler separate from its lid and in a vertically divided cross sectional view.

FIG. 5A illustrates a vertically divided cross section of the lid 10. Flange area 22 and insulation area 46 are clearly shown. Threaded portion 25 is also shown for threadably and removably engaging the lid to the cooler main body portion. FIG. 5B illustrates a vertically divided main body portion of the cooler, more clearly showing the elevated bottom portion 32, the bulging dome 40 on the elevated bottom, the keg collar 42, and the tapered top area 20 including a threaded wall 22 thereon for threadably receiving a portion of lid 10. Lid 10 may come to rest on surface 50 while threadably received, and the top flange area 22 of the lid may rest upon the top surface 54 of the threaded wall. A keg received in the keg cooler will be flush against an imaginary plane at the level of surface 54, and shall rest on seat 40 having the raised dome 40, all of which rest on top of an elevated false bottom section 32 at a height at least one quarter the radius of the cooler's cylindrical configuration from its inner surface 62. An outer shell 60 of the main body portion includes in integral construction therewith, the recessed grasping areas 18. In a preferred embodiment, this shell may be formed of plastic via a simple molding process. Nevertheless, other conventional material may be used. This outer shell 60, together with inner surface 62, forms compartments 44 for holding insulation 65. In addition, the elevated false bottom section 32 is also filled with insulation 65 therein.

Recessed grasping areas 18 integral with the outer shell protrude through inner surface 62 and come in close juxtaposition with a beer keg located in the cooler, if any, for providing a stopping or action when the keg is disturbed. This feature enhances the stability of the beer keg located in the cooler structure.

Thus, the keg collar 42, the recessed and intruding areas 18, and the bulging dome 40 together act on a beer keg located in the cooler to provide a secure and stable positioning of the same. The keg is prevented from excessive motion such as translational or rotational behavior within the cooler.

The removable and insulated lid 10 provides an enclosed environment for any beer keg located in the cooler. It is threadably engaged with the main body portion of the cooler and therefore does not easily become unexpectedly disengaged. The tap hole thereon allows for connection to beer keg contents through an opening on the keg without disengaging the lid from the cooler main body.

SUMMARY OF MAJOR ADVANTAGES OF THE INVENTION

In describing an improved beer keg cooler in accordance with a preferred embodiment of the invention those skilled in the art will recognize several advantages which singularly distinguish the subject invention from the heretofore known prior art.

A particular advantage of the subject invention is the provision of a smoothly uniform cylindrical external configuration. Such configuration, as compared to the oblique or angular shape of coolers in the prior art, diminishes the likelihood of deformation and other damage to the cooler by optimizing the angle of deflection of force from external impact.

Another significant advantage of the subject invention is the elevated disposition of the beer keg within the cooler. As compared with the coolers in the past, the subject invention permits the beer keg to be positioned at an enhanced elevation and thus minimize the vertical distance of travel in piping the beer to an elevated dispenser via a pump.

Another significant advantage of the subject invention is provided through the integral handle recesses extending inwardly from the main body of the cooler. An integral construction is less complex and has fewer parts which may fail. In addition, the inwardly extending recesses provide a less bulky handle structure, thus minimizing potential hazard. The inwardly extending recesses also provide a stabilizing guiding action on a beer keg inserted in said cooler as they terminate in close proximity to the perimeters of said inserted beer keg. This guided action provides enhanced stability of the beer keg in said cooler.

An elevated and enlarged false bottom member conforms to the base of a keg to hold the keg in an elevated, but stable posture.

The dimensional proportion of the external surface of the keg cooler permits the application of conventional beer can labeling and thus the cooler facilly serves as a marketing display stand, goods identifier and dispenser.

In describing the invention, references have been made to a preferred embodiment. Those skilled in the art, however, and familiar with the disclosure of the subject invention, may recognize additions, deletions, substitutions, modifications, and/or other changes which will fall within the perview of the instant invention.

I claim:

1. A beer display, key cooler comprising, a main body portion having a generally uniform and smooth cylindrical external shell with a top and bottom configured in the general shape of a conventional can of beer and operative to receive indicias of beerthereon;

said main body portion having an internally raised bottom section for supporting a beer key inserted in said cooler such that a top of a beer key is approximately flush with a top rim of said main body portion;

said internally raised bottom section including a centrally elevated bulging platform on the surface thereof for fitting into a corresponding recess in a base portion of a beer keg;

first and second inwardly extending angular recesses on opposing sides of and integral in structure with said external shell for providing a grasping area on opposing sides of said cooler;

said angular recesses being located at approximately equal vertical elevations with respect to said bottom;

an annular keg collar along the internal cylindrical perimeters of said shell and immediately above said raised bottom, for providing a guiding action for said inserted beer keg;

a drain hole located on said external shell at a level of elevation between said inwardly extending recesses and said annular collar; and a circular lid having an openable tab hole thereon, for removably covering the top of said cooler through which said beer key is inserted.

2. A beer display, keg cooler as defined in claim 1 wherein:

said main body portion has tapered indented surface at one end thereof for joining with said lid; and said circular lid having a circumferential flange for providing easy manipulation thereof.

3. A beer display, keg cooler as defined in claim 2 wherein:

said taperedly indented surface includes a threaded wall portion for removably receiving said lid and also for partially supporting said flange of said lid.

4. A beer display, keg cooler as defined in claim 1 wherein:

said lid includes insulation material in at least a portion thereof; and said cylindrical shell includes compartments therein containing insulation material.

5. A beer display, keg cooler as defined in claim 4 wherein:

said internally raised bottom section is filled with insulation material.

6. A beer display, keg cooler comprising:

a main body portion having a generally uniform and smooth cylindrical external shell with a top and bottom configured in the general shape of a conventional can of beer and operative to receive indicia of beer thereon;

said main body portion having an internally raised bottom section for supporting a beer keg inserted in said cooler such that the top of a beer keg is approximately flush with a top rim of said main body portion;

said internally raised bottom section including a centrally elevated bulging platform on the surface thereof for fitting into a corresponding recess in a base portion of a beer keg;

first and second inwardly extending angular recesses on opposing sides of and integral in structure with said external shell for providing a grasping area on said cooler;

said angular recess being located at approximately equal vertical elevation with respect to said bottom;

a circular lid having an openable tab hole thereon, for removably covering the top of said cooler through which said beer keg is inserted;

said main body portion having a tapered indented surface at said top end for thereof, for joining with said lid;

said circular lid having acircumferential flange for providing easy manipulation thereof;

said lid including insulation material across at least a portion thereof; and said cylindrical shell being lined on the interior surface with insulation material.

7. A beer display, keg cooler as defined in claim 6 above wherein:

said internally raised bottom is of a height equal to at least one quarter the diameter of said generally cylindrical shell, whereby said beer keg inserted therein adopts a correspondingly enhanced elevation for easy operation and access thereto.

8. A beer display, keg cooler as defined in claim 7 above wherein:

each said inwardly extending integral recess terminates in close proximity to said inserted beer keg for providing a guiding action with respect thereto.

9. A beer display, keg cooler as defined in claim 8 above further comprising:

an annular keg collar along the internal cylindrical perimeters of said shell and immediately above said raised bottom, for providing a guiding action on said inserted beer keg.

10. A beer display, keg cooler as defined in claim 9 above wherein:

a drain hole is located on said external shell at the level of elevation between said inwardly extending recesses and said annular collar.

11. A beer display, keg cooler structure as defined in claim 6 above wherein:

said taperedly indented surface includes a threaded wall portion for removably receiving said lid and also for partially supporting said flange of said lid.

12. A beer display, keg cooler as defined in claim 6 above wherein:

said internally raised bottom section is filled with insulation material.

* * * * *